US006540191B2

(12) United States Patent
Liu

(10) Patent No.: US 6,540,191 B2
(45) Date of Patent: Apr. 1, 2003

(54) FOOT STAND STRUCTURE OF AN ADJUSTABLE COMPUTER DESK

(76) Inventor: Lin-Ho Liu, P.O. Box No. 6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/810,612

(22) Filed: Mar. 19, 2001

(65) Prior Publication Data

US 2002/0130228 A1 Sep. 19, 2002

(51) Int. Cl.[7] ..... F16M 13/00

(52) U.S. Cl. ..... 248/422; 248/161; 74/89.13; 74/89.28; 108/147

(58) Field of Search ..... 74/89.13, 89.28; 108/545, 144.11, 147, 147.11; 254/92; 248/422, 405, 161, 624

(56) References Cited

U.S. PATENT DOCUMENTS 186,757 A * 1/1877 Ramseyer ..... 248/422
633,051 A * 9/1899 Synder ..... 248/422
914,538 A * 3/1909 Watkins ..... 248/422
981,113 A * 1/1911 Richards ..... 108/147
1,300,229 A * 4/1919 Whitehouse ..... 248/422
1,958,424 A * 5/1934 Gebhard ..... 74/89.28
2,342,631 A * 2/1944 Hillenbrand ..... 108/147
2,368,748 A * 2/1945 Doty ..... 108/147
2,733,885 A * 2/1956 Brown et al. ..... 248/161
5,845,590 A * 12/1998 Seidl ..... 108/147
6,024,025 A * 2/2000 Koch et al. ..... 108/147
6,131,870 A * 10/2000 Tseng ..... 248/406.1

* cited by examiner

*Primary Examiner*—Anita King
*Assistant Examiner*—Gwendolyn Baxter
(74) *Attorney, Agent, or Firm*—Troxell Law Office PLLC

(57) ABSTRACT

A foot stand structure of an adjustable computer desk, more especially, a foot stand structure of an adjustable computer capable of performing high efficient adjustment for desk body such as those used for placing the computer on it during operations. The structure not only efficiently and precisely adjusts that height of the computer desk, but also surpasses the inconvenience caused by the disassembly of the foot stand of the prior computer desk for adjusting the height. The structure includes adjusting frame seats, a link shaft rod, a set of inner rods with helical teeth and matching threaded bushes, a set of smooth inner rods and bushes, a foot stand and an external rotating handle bar.

1 Claim, 6 Drawing Sheets

FOOT STAND STRUCTURE OF AN ADJUSTABLE COMPUTER DESK

BACKGROUND OF THE INVENTION

1. Field of the Invention

The invention herein relates to a foot stand structure for an adjustable computer desk, more especially, such a foot stand structure capable of performing efficient adjustment for a desk body such as those used for a computer. The structure enables adjusting frame seats, a link shaft rods, a set of inner rods with helical teeth and the matching treaded bushes, a set of smooth inner rods and bushes, and a foot stand assembled with an external rotating handle bar.

2. Description of the Prior Art

The familiar adjustable foot stand of the conventional computer desk has the inner rod and the outer bush with interlocking holes in the same size. After the interlocking holes are pushed against each other, the tenons will be interlocked however, using this kind of structure to adjust the height of the computer desk still has the shortcomings of having to remove heavy objects on the computer desk or being unable to precisely adjust the computer desk.

SUMMARY OF THE INVENTION

Therefore, the inventor of the invention herein after many tests and experiments, has culminated in a prefect innovative patent. To enable a further understanding of the features and the innovation of the invention herein, the brief description of the drawings below is followed by the detailed description of the preferred embodiment.

DETAILED DESCRIPTION OF THE PREFERRED EMBODIMENT

Figure 1:
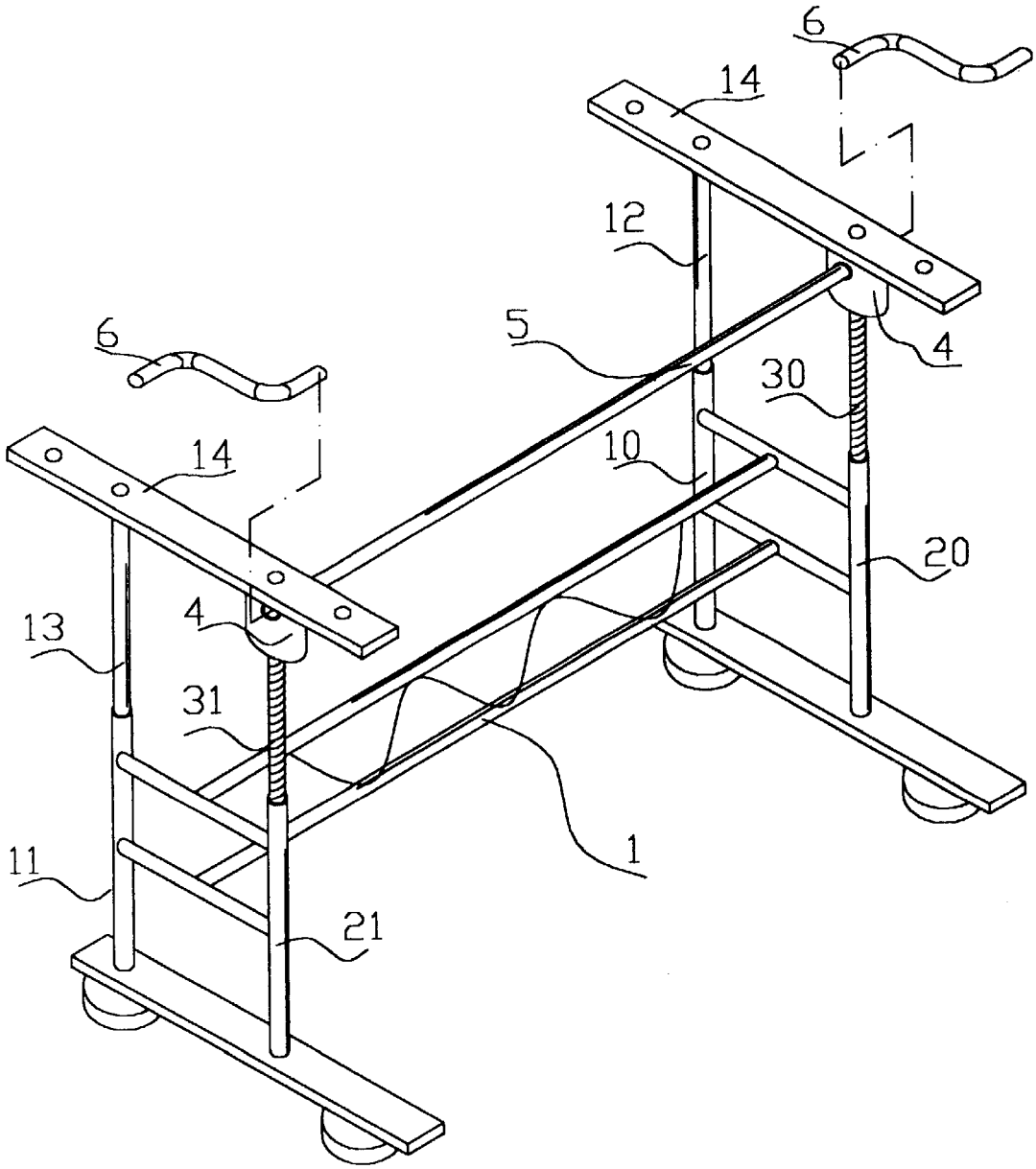
FIG. 1 is a perspective view of he desk feet of the present invention herein.
Figure 2:
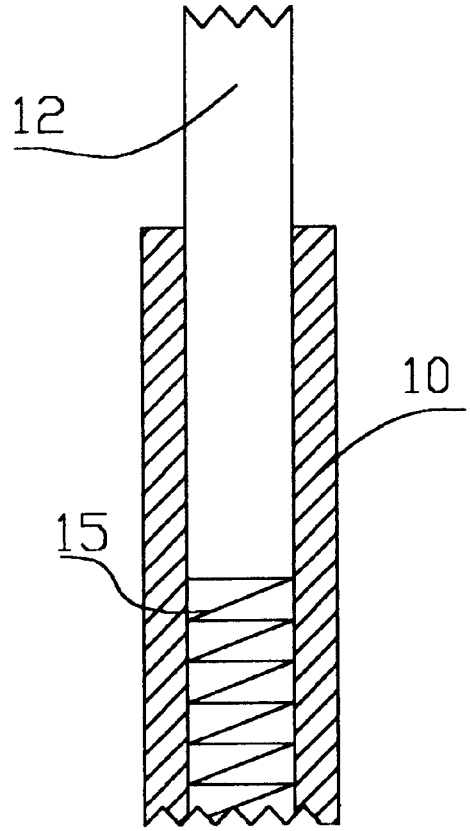
FIG. 2 is a side view and cross section of the connection between the smooth inner rod and bush of the present invention.
Figure 3:
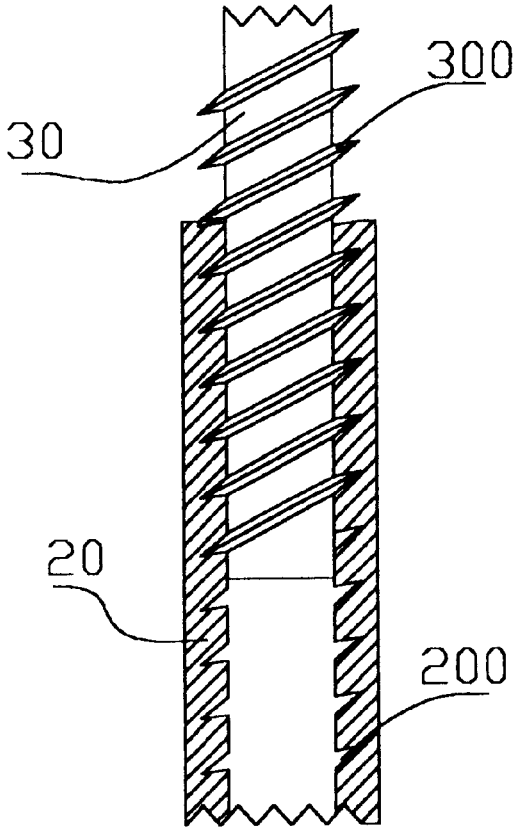
FIG. 3 is a side view and cross section of the mesh between the inner rod with helical teeth and the threaded bush of the present invention.

Referring to FIGS. 1, 2 and 3, the invention herein comprises a foot stand (1) mounted by a seat of threaded bushes (20, 21) thereon; the threaded bushes (20, 21) are engaged by a set of inner rods with a helical teeth (30, 31) helically extending inside the threaded bushes (20, 21). The inner rods with helical teeth (30, 31) extend respectively upwards into the inner space of an adjusting frame seat (4). A link shaft rod (5) connects the link between the two transverse adjusting frame seats (4), and an external rotating handle bar (6) is provided. The main function of the foot stand (1) is to fix the foot stand structure of the computer desk. In addition to having a set of threaded bushes (20, 21) and a set of inner rods with helical teeth (30, 31) capable of extending inside the threaded bushes (20, 21) on one side surface of the longitudinal sides of the foot stand (1), there is another set of smooth bushes (10, 11) and inner rods (12, 13) on the longitudinal sides. A transverse extension rod (14) connects the inner rods with helical teeth (30, 31) with the adjusting frame seats (4) thereon and the smooth inner rods (12, 130). A powerful spring (15) is mounted on the bottom portion inside the smooth bushes (10, 11) to provide supporting force for the smooth inner rods (12, 13) relative to the desk body. The threads (2000 are formed on the inner side surfaces of the threaded bushes (20, 21) such that the sizes and the forms of the threads (200) mesh the helical teeth (300) on the column surfaces of the inner rods with helical teeth (30, 31), allowing the inner rods with helical teeth (30, 31) to freely extend inside the threaded bushes (20, 21). The rotating handle bar (6) can be inserted in any of the adjusting frame seats (4) for operating based on the specific need of the computer desk user.

Figure 4:
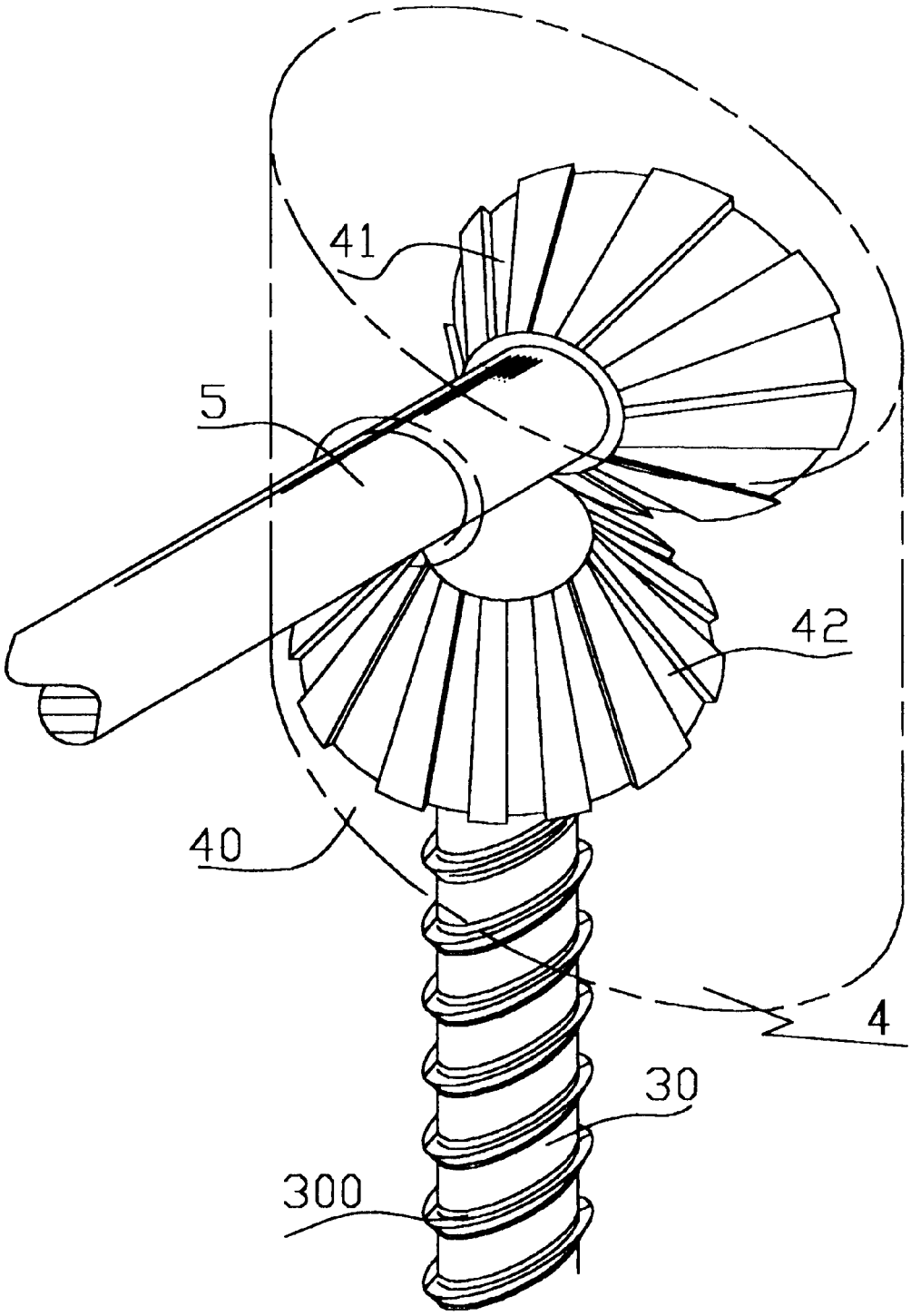
FIG. 4 is an isometric and perspective view of the adjusting frame seat of the present invention.
Figure 5:
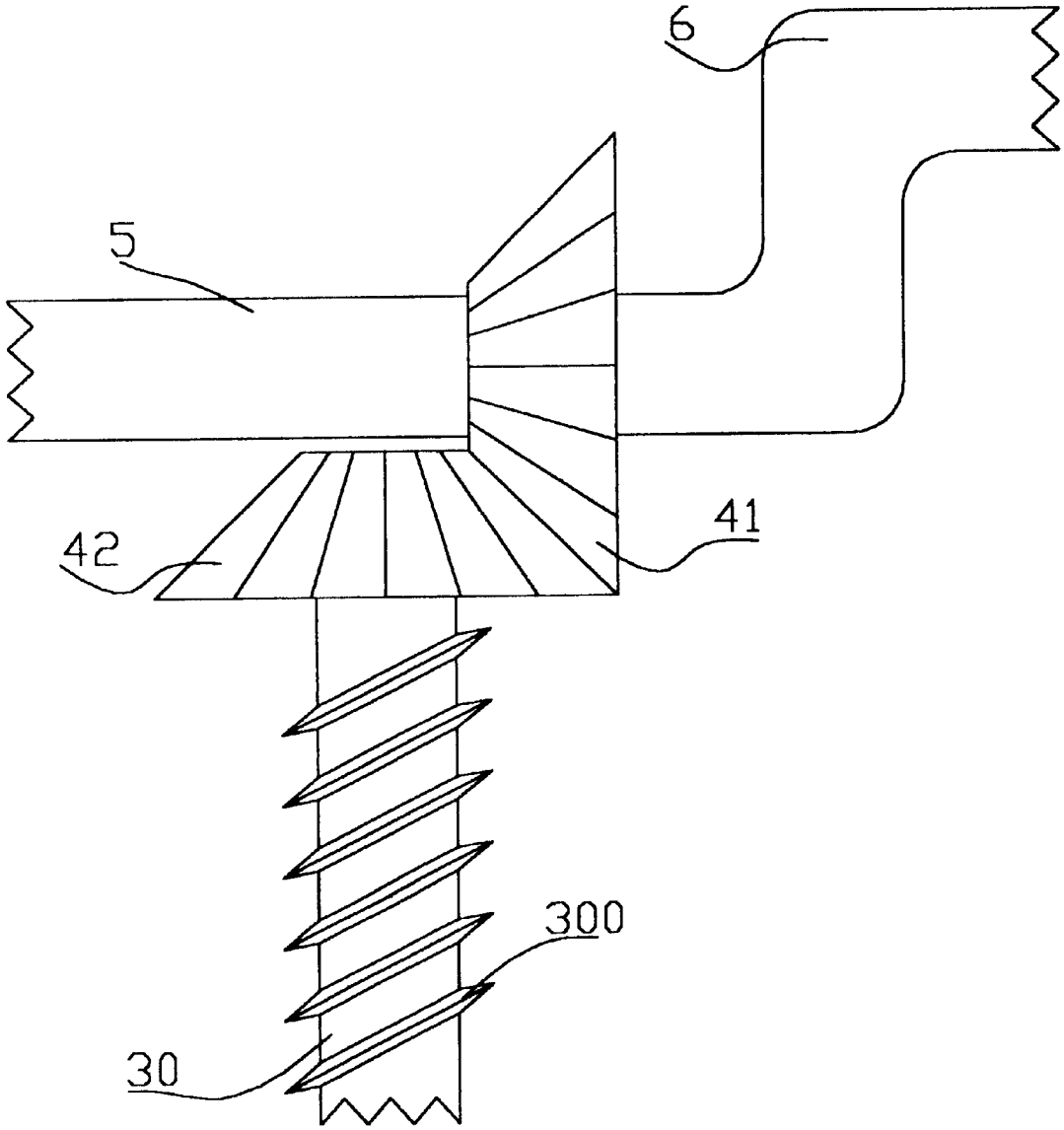
FIG. 5 is a side view of the bevel gears of the present invention.

Referring to FIGS. 4 and 5, the structure of the adjusting frame seat (4) of the invention herein comprises a shell body (40), vertical and horizontal bevel gears (41, 42) in mesh and mounted therein. The central portion of the vertical bevel gear (41) is connected with both the link shaft rod (5) in the front and at the rear portions and the external rotating handle bar (6) approximately at the central area of the penetrated portion. The link shaft rod (5) connects the central portion of another vertical bevel gear (41) disposed in the adjusting frame seat (4) on the top end of the inner rod with helical teeth (31) for producing the link movement. The horizontal bevel gear (42) extends from the inner portion to connect with the inner rod with helical teeth (30). The extended and connected inner rod with helical teeth (30) extends downwards and through the shell body (40) to be threaded to the threaded bushes (20).

Figure 6:
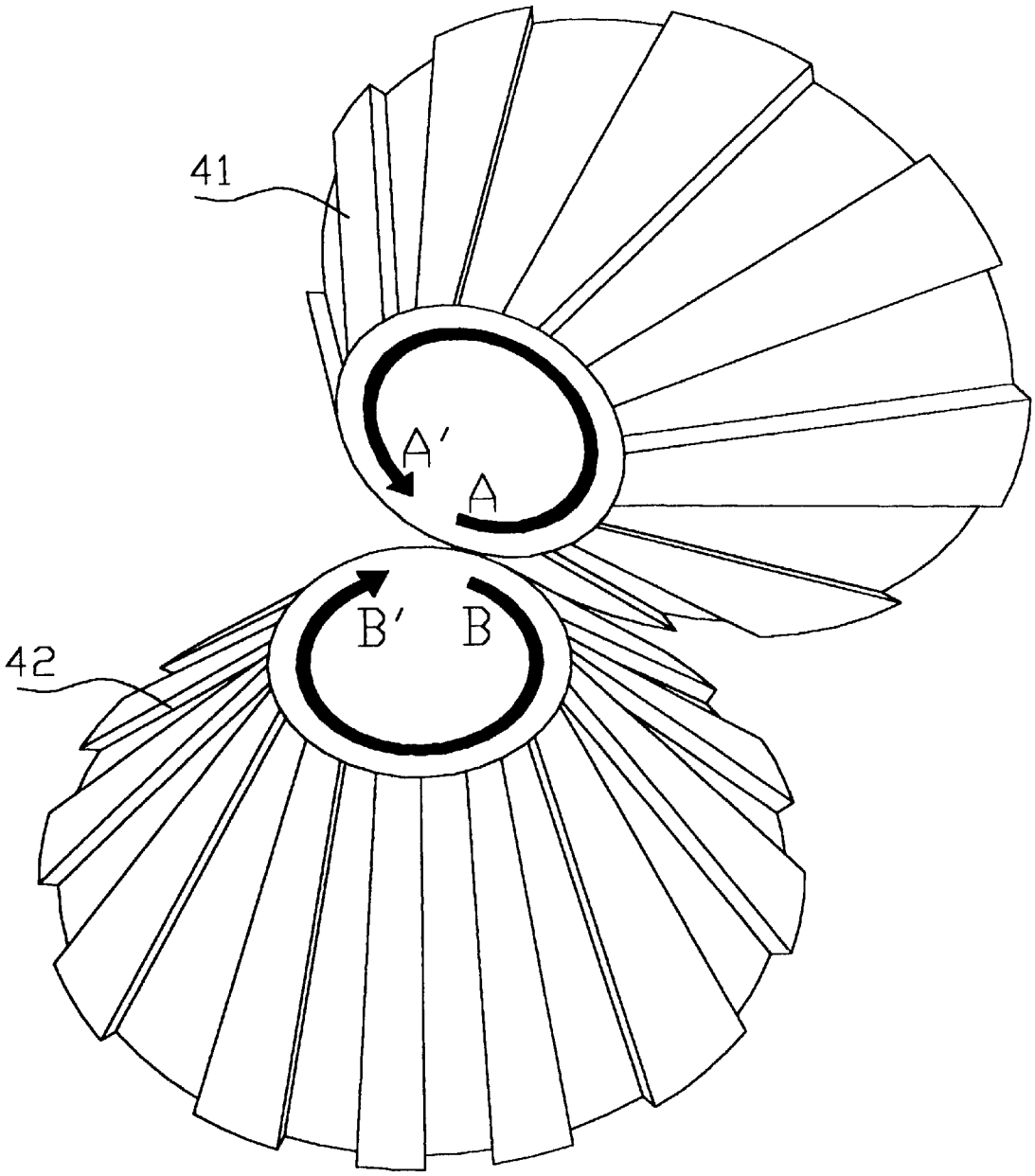
FIG. 6 is a drawings showing he movement of the bevel gears of the present invention.
Figure 7:
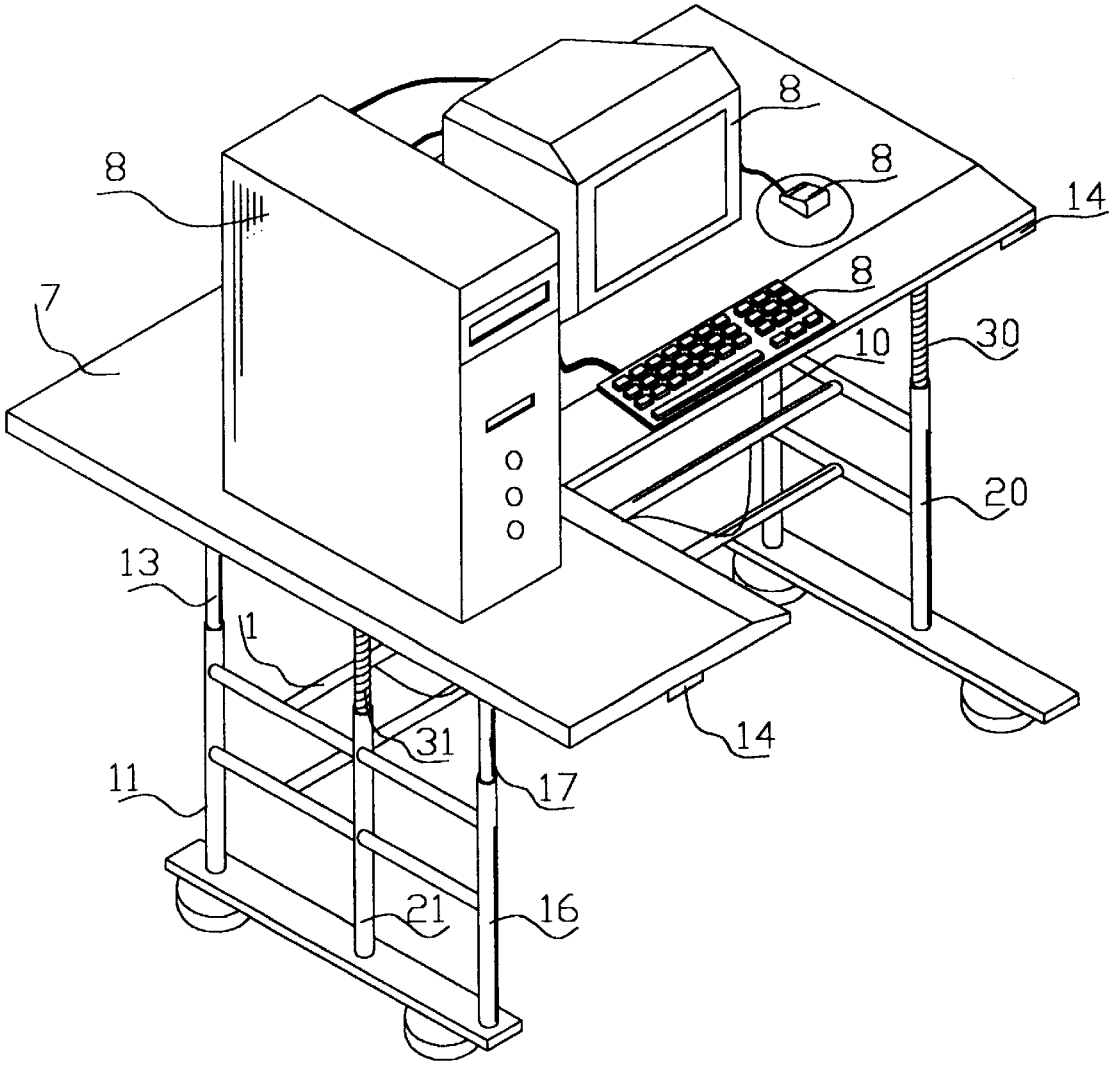
FIG. 7 is a perspective view of the present invention.

Referring again from FIGS. 1 to 7, when lowering the height of the computer desk surface (7), one only needs to insert the rotating handle bar (6) into any of the adjusting frame seat (4) to connect with the vertical bevel gear (41). Through the rotation of the rotating handle bar (6), the vertical bevel gear (41) will rotate in the same direction. As shown in FIG. 6, when the vertical bevel gear (41) rotates in the direction of A–A', at the same time, it will drive the link shaft rod (5) and another vertical bevel gear (41) disposed in the adjusting frame seat (4) on the top end of the inner rod with helical teeth (31) to rotate to the same direction of A–A' and, the vertical bevel gears (41) will drive the two horizontal bevel gears (42) to rotate in the direction B–B'. The inner rods with helical teeth (30, 31) are curved to thread downwards into the threaded bushes (20, 21) and, the smooth inner rods (12, 13) will slide into the smooth bushes (10, 11) at the same time. Thus, the computer desk surface (7) and the objects on the desk (8) can be adjusted lower. When the user tries to elevate the height of the computer desk surface, he only has to rotate the rotating handle bar (6) in the reverse direction.

Referring to FIG. 7 again, if the shape of the computer desk surface (7) is changed into an L-shaped or other shapes, the length of the transverse extension rod (14) can be extended and another set of a smooth bush (16), a smooth inner rod (17) and a powerful spring (15) can be added based on the need to increase the supporting force and the function of being easy to be elevated or lowered.

What is claimed is:

1. A foot stand to a foot stand structure of an adjustable computer desk, comprising of a foot stand mounted by a set of threaded bushes thereon, the threaded bushes disposed by a set of inner rods with helical teeth inside the threaded bushes, the inner rods with the helical teeth extending respectively upwards and inserted into an inner space of an adjusting frame seat, a link shaft rod connecting between two transverse adjusting frame seats, and an external rotating handle bar, is characterized that:

the foot stand has a set of threaded bushes and a set of inner rods with helical teeth extending inside the threaded bushes mounted on the foot stand; a set of smooth bushes and inner rods mounted on the foot stand; a transverse extension rod connecting the inner rods with the helical teeth with the smooth inner rods; a spring mounted on bottom portion inside the smooth bushes;

the threaded bushes having threads formed on inner side surface, engaged by helical teeth on the inner rods;

adjusting frame seats each including a shell body, with one vertical and one horizontal bevel gear in mesh with each other and mounted therein; central portions of the vertical bevel gears are connected with a link shaft rod and one engageable with an external rotating handle bar, the adjusting frame seats at a top end of the inner rods with the helical teeth; and the horizontal bevel gear connected with the inner rods with the helical teeth.

* * * * *